US010890391B1

(12) United States Patent
Geissele et al.

(10) Patent No.: US 10,890,391 B1
(45) Date of Patent: Jan. 12, 2021

(54) ANTI-RATTLE BIASING DEVICES FOR FIREARMS

(71) Applicant: WHG Properties, LLC, North Wales, PA (US)

(72) Inventors: William H. Geissele, Lower Gwynedd, PA (US); Timothy Ambrose, Sellersville, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/879,939

(22) Filed: May 21, 2020

(51) Int. Cl.
*F41A 3/66* (2006.01)

(52) U.S. Cl.
CPC ..... *F41A 3/66* (2013.01)

(58) Field of Classification Search
CPC ..... F41A 3/66
See application file for complete search history.

(56) References Cited

U.S. PATENT DOCUMENTS 9,188,399 B1 * 11/2015 Findlay ..... F41A 11/00
10,066,888 B2 * 9/2018 Chang ..... F41A 17/36
10,378,840 B1 * 8/2019 Huang ..... F41A 9/59
2018/0106567 A1 * 4/2018 Meyers ..... F41A 3/66
2018/0128562 A1 * 5/2018 Carsey ..... F41A 11/00

OTHER PUBLICATIONS

Armory Dynamics Stainless Spring Loaded Receiver Tension Screw Customer Review Page (https://www.armorydynamics.com/Armory-Dynamics-Stainless-Spring-Loaded-Receiver-Tension-Screw_p_30.html) (Year: 2019).*
Nylon Tipped Tension Set Screw at http://www.aeroprecisionusa.com/nylon-tipped-tension-set-screw (Accessed May 2020).
ACCU—Wedge Upper Receiver Tightening Wedge at https://www.deltateamtactical.com/ACCU-Wedge-Upper-Receiver-Tightening-Wedge-_p_4537.html (Accessed May 2020).
Armory Dynamics Stainless Spring Loaded Receiver Tension Screw at https://www.armorydynamics.com/Armory-Dynamics-Stainless-Spring-Loaded-Receiver-Tension-Screw_p_30_html (Accessed May 2020).

* cited by examiner

*Primary Examiner* — Reginald S Tillman, Jr.
(74) *Attorney, Agent, or Firm* — Fox Rothschild LLP

(57) ABSTRACT

An anti-rattling biasing device for firearms includes a spring configured to exert a biasing force against an upper receiver and a lower receiver of the firearm. The biasing force urges the upper and lower receivers firmly into contact with the pins that couple the upper and lower receivers, inhibiting small back and forth movement between the upper and lower receivers and thereby reducing or eliminating rattling of the upper and lower receivers when assembled together.

16 Claims, 7 Drawing Sheets

ANTI-RATTLE BIASING DEVICES FOR FIREARMS

BACKGROUND

Many firearms, such as M4 and AR15 rifles, are constructed of two major components groups in the form of an upper receiver group and a lower receiver group. The upper receiver group may include an upper receiver, and other components such as a barrel, a bolt carrier group, a charging handle, and a handguard mounted directly or indirectly on the upper receiver. The lower receiver group likewise may include a lower receiver, and other components such as a trigger assembly, a butt stock, a buffer, and a grip mounted directly or indirectly on the lower receiver.

The upper receiver typically is connected to the lower receiver by removable pins located on the forward and rearward ends of the upper and lower receivers. Due to normal manufacturing tolerances and normal wear from usage, the upper receiver can undergo a small amount of back and forth movement in relation to the lower receiver. Because the upper and lower receivers and their connecting pins are metal, this movement can manifest itself as rattling that can be heard and felt when the firearm is being handled. While such rattling has no effect on the functionality or safety of the firearm, it is often viewed by the user as a sign of poor quality in the firearm, and in some cases can affect a user's shooting accuracy.

Plastic inserts have been used to reduce rattling between upper and lower receivers. For example, plastic inserts may be placed between the takedown lug on the upper receiver and the adjacent surfaces of the lower receiver. These inserts, however, typically need to be trimmed to precisely conform to the gap between the takedown lug and the adjacent surfaces of the lower receiver, so that the insert firmly urges the upper and lower receivers into contact with their connecting pins. It can be difficult, however, to trim such inserts to the precise dimensions needed to achieve this desired effect, while still allowing the upper and lower receivers to be mated properly. Also the need to trim and install the insert adds extras steps and complexity to the assembly process for the firearm.

SUMMARY

The present disclosure relates generally to devices that exert a biasing force on an upper and lower receiver of a firearm to reduce or eliminate rattling of the upper and lower receivers.

In one aspect, the disclosed technology relates to a lower receiver group for a firearm, the lower receiver group including: a lower receiver configured to mate with an upper receiver of the firearm; and a biasing device mounted on the lower receiver, the biasing device including a spring configured to compress when the upper receiver is mated with lower receiver, and to exert opposing forces on the upper receiver and the lower receiver in response to the compression of the spring. In one embodiment, the biasing device positioned at least partly within a bore formed in the lower receiver. In another embodiment, the biasing device further includes a plunger, and the spring is positioned at least partly within the plunger. In another embodiment, the biasing device further includes a retaining pin configured to retain the plunger and the spring in the bore. In another embodiment, the plunger includes a substantially cylindrical first portion having a first diameter; a substantially cylindrical second portion having a second diameter greater than the first diameter; and a lip that connects the first and second portions.

In another embodiment, the bore includes a first portion configured to receive the first portion of the plunger and having a diameter approximately equal to the diameter of the first portion of the plunger; and a second portion configured to receive the second portion of the plunger and having a diameter approximately equal to the diameter of the second portion of the plunger; and the lower receiver includes a lip facing the second portion of the bore and configured to contact the lip of the plunger to limit movement of the plunger and the spring in a first direction. In another embodiment, the biasing device further includes a retaining pin configured to limit movement of the plunger and the spring in a second direction opposite the first direction. In another embodiment, the lower receiver defines a cavity configured to receive a takedown lug on the upper receiver when the upper and lower receivers are mated; the spring is configured to extend into the cavity when the upper and lower receivers are not mated; and the spring is further configured to be compressed by the takedown lug when the upper and lower receivers are mated.

In another embodiment, the biasing device further includes a plunger; the spring is positioned within the plunger; and the plunger is configured so that the takedown lug contacts the plunger when the upper and lower receivers are mated. In another embodiment, the plunger and the spring are positioned at least partly within a bore formed in the lower receiver, and the bore extends between the cavity and a lower surface of the lower receiver. In another embodiment, the lower receiver is configured to be coupled to the upper receiver by a first and a second pin; the opposing forces on the upper receiver and the lower receiver urge the first pin into contact with structure of the upper receiver and the lower receiver adjacent the first pin; and the opposing forces on the upper receiver and the lower receiver urge the second pin into contact with structure of the upper receiver and the lower receiver adjacent the second pin.

In another aspect, the disclosed technology relates to a firearm, including: an upper receiver group including an upper receiver; and a lower receiver group including: a lower receiver configured to mate with the upper receiver; and a biasing device including a spring configured to compress when the upper receiver is mated with lower receiver, and to exert opposing forces on the upper receiver and the lower receiver in response to the compression of the spring. In one embodiment, the biasing device is mounted on the lower receiver. In another embodiment, the biasing device is positioned at least partly within a bore formed in the lower receiver; the biasing device further includes a plunger; and the spring is positioned at least partly within the plunger.

In another embodiment, the plunger includes a substantially cylindrical first portion having a first diameter; a substantially cylindrical second portion having a second diameter; and a lip that connects the first and second portions; the bore includes a first portion configured to receive the first portion of the plunger and having a diameter approximately equal to the diameter of the first portion of the plunger; and a second portion configured to receive the second portion of the plunger and having a diameter approximately equal to the diameter of the second portion of the plunger; and the lower receiver includes a lip facing the second portion of the bore and configured to contact the lip of the plunger to limit movement of the plunger and the spring in a first direction.

In another embodiment, the biasing device further includes a retaining pin configured to limit movement of the plunger and the spring in a second direction opposite the first direction. In another embodiment, the upper receiver includes a takedown lug; the lower receiver defines a cavity configured to receive the takedown lug when the upper and lower receivers are mated; the spring is configured to extend into the cavity when the upper and lower receivers are not mated; and the spring is further configured to be compressed by the takedown lug when the upper and lower receivers are mated. In another embodiment, the biasing device further includes a plunger; the spring is positioned within the plunger; and the plunger is configured so that the takedown lug contacts the plunger when the upper and lower receivers are mated. In another embodiment, the biasing device is positioned at least partly within a bore formed in the lower receiver; and the bore extends between the cavity and a lower surface of the lower receiver.

In another embodiment, the firearm further includes a pivot pin configured to couple a forward end of the upper receiver to a forward end of the lower receiver; and a takedown pin configured to couple the takedown lug to the lower receiver, wherein: the opposing forces on the upper receiver and the lower receiver urge the pivot pin into contact with structure of the upper receiver and the lower receiver adjacent the pivot pin; and the opposing forces on the upper receiver and the lower receiver urge the takedown pin into contact with the takedown lug and structure of the receiver adjacent the takedown pin.

BRIEF DESCRIPTION OF THE DRAWINGS

The following drawings are illustrative of particular embodiments of the present disclosure and do not limit the scope of the present disclosure. The drawings are not to scale and are intended for use in conjunction with the explanations in the following detailed description.

DETAILED DESCRIPTION

Figure 1:
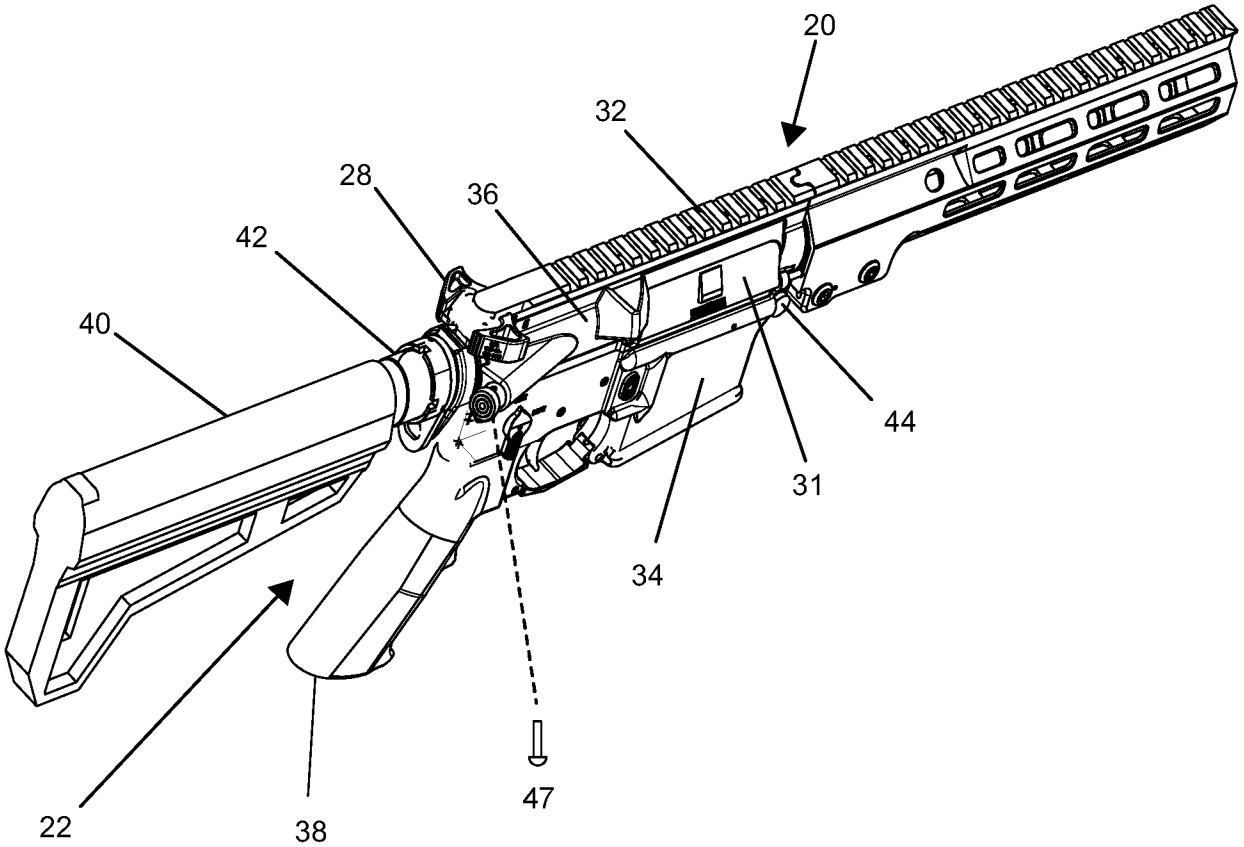
FIG. 1 illustrates a top-rear perspective view of an upper receiver group and a lower receiver group of a firearm, depicting upper and lower receivers of the upper and lower receiver groups in a fully mated condition.

The following discussion omits or only briefly describes conventional features of firearms and firearm mechanisms that are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest reasonable interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. As used herein, the term "about" in reference to a numerical value means plus or minus 15 percent of the numerical value of the number with which it is being used.

Embodiments of the present disclosure relate generally to an anti-rattle biasing device for a firearm. Non-limiting embodiments of the device are described below with reference to FIGS. 1-11.

FIGS. 1-3, 6, and 8 depict an upper receiver group 20 and a lower receiver group 22 of a firearm 10. The firearm 10 is an M4/AR15-type rifle. The inventive concepts disclosed herein are described in connection with an M4/AR15-type rifle for illustrative purposes only; the inventive concepts can be applied to other types of firearms, including rifles, pistols, handguns, and the like.

The upper receiver group 20 includes an upper receiver 26. The upper receiver group 20 also includes a charging handle 28, an assist 30, an ejection port cover 31, and a handguard 32 mounted on the upper receiver 26. Other components of the upper receiver group 20, such as a barrel and a bolt carrier group, are not depicted in the figures, for clarity of illustration.

The lower receiver group 22 includes a lower receiver 34, and a trigger assembly 36 mounted within the lower receiver 34. The lower receiver group 22 also includes a pistol grip 38, a buffer tube 40, and a buttstock 42 mounted on the lower receiver 34. Other components of the lower receiver group 22, such as a buffer and a buffer spring, are not depicted in the figures, for clarity of illustration.

The upper and lower receivers 26, 34 are coupled to each other at their respective forward and rearward ends. The forward ends of the upper and lower receivers 26, 34 are coupled by a pivot pin 44, shown in FIGS. 1-3, 6, and 8. The pivot pin 44 is disposed in through holes 46 formed in two flanges 48 located at the forward end of the lower receiver 34. One of the flanges 48 is visible in FIG. 10. The pin 44 also is disposed in a through hole formed in a flange (not shown) located at the forward end of the upper receiver 26.

The rearward ends of the upper and lower receivers 26, 34 are coupled by a takedown pin 47, shown in FIG. 1. The takedown pin 47 is disposed in through holes 50 formed in opposite sides of the lower receiver 34; and in a through hole 52 formed in a takedown lug 54 that extends downward from the rearward end of the upper receiver 26.

Figure 2:
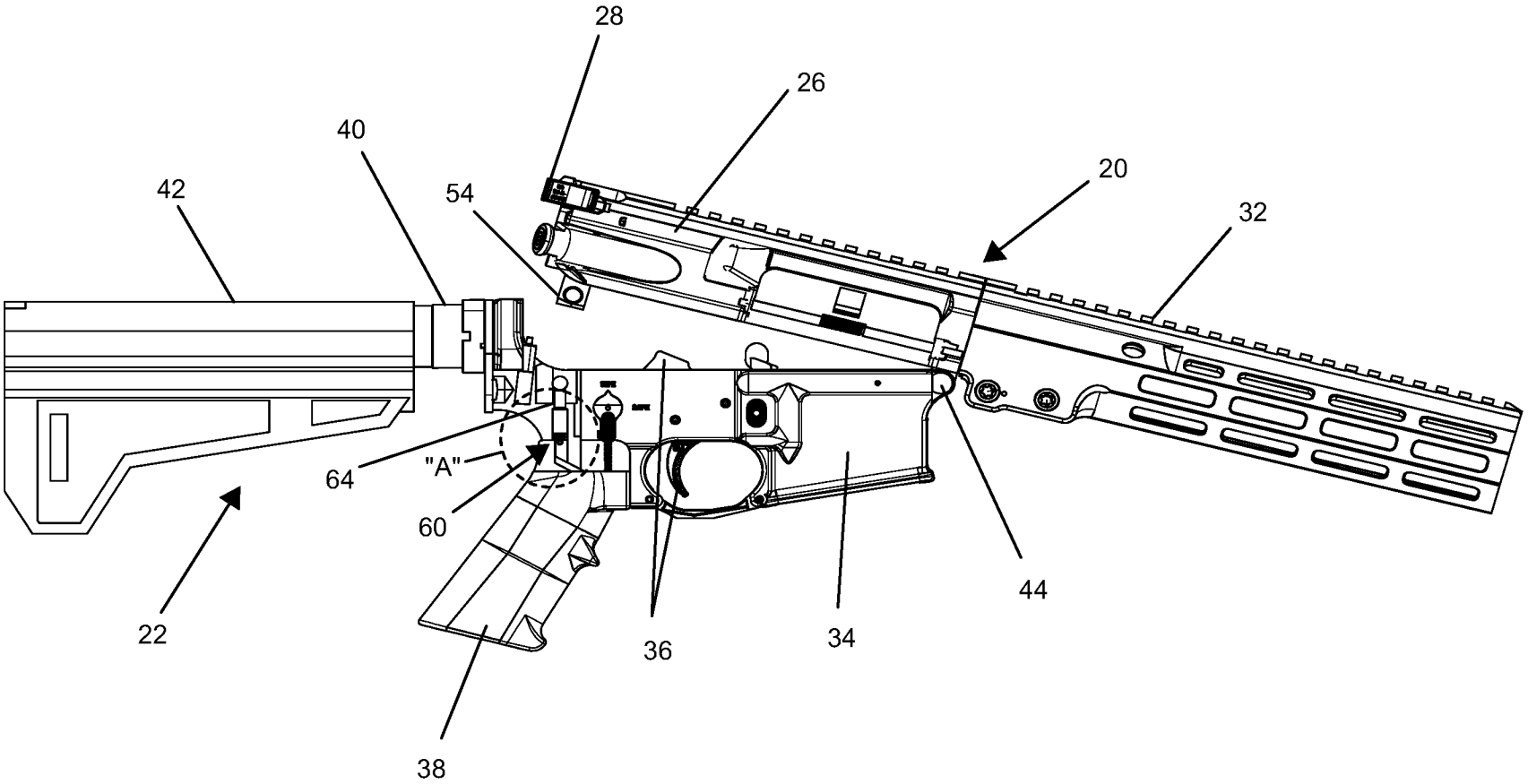
FIG. 2 illustrates a side view of the upper and lower receiver groups shown in FIG. 1, depicting the upper and lower receivers in a partially mated condition, with a portion of the lower receiver cut away to reveal an anti-rattle biasing device installed on the lower receiver.
Figure 3:
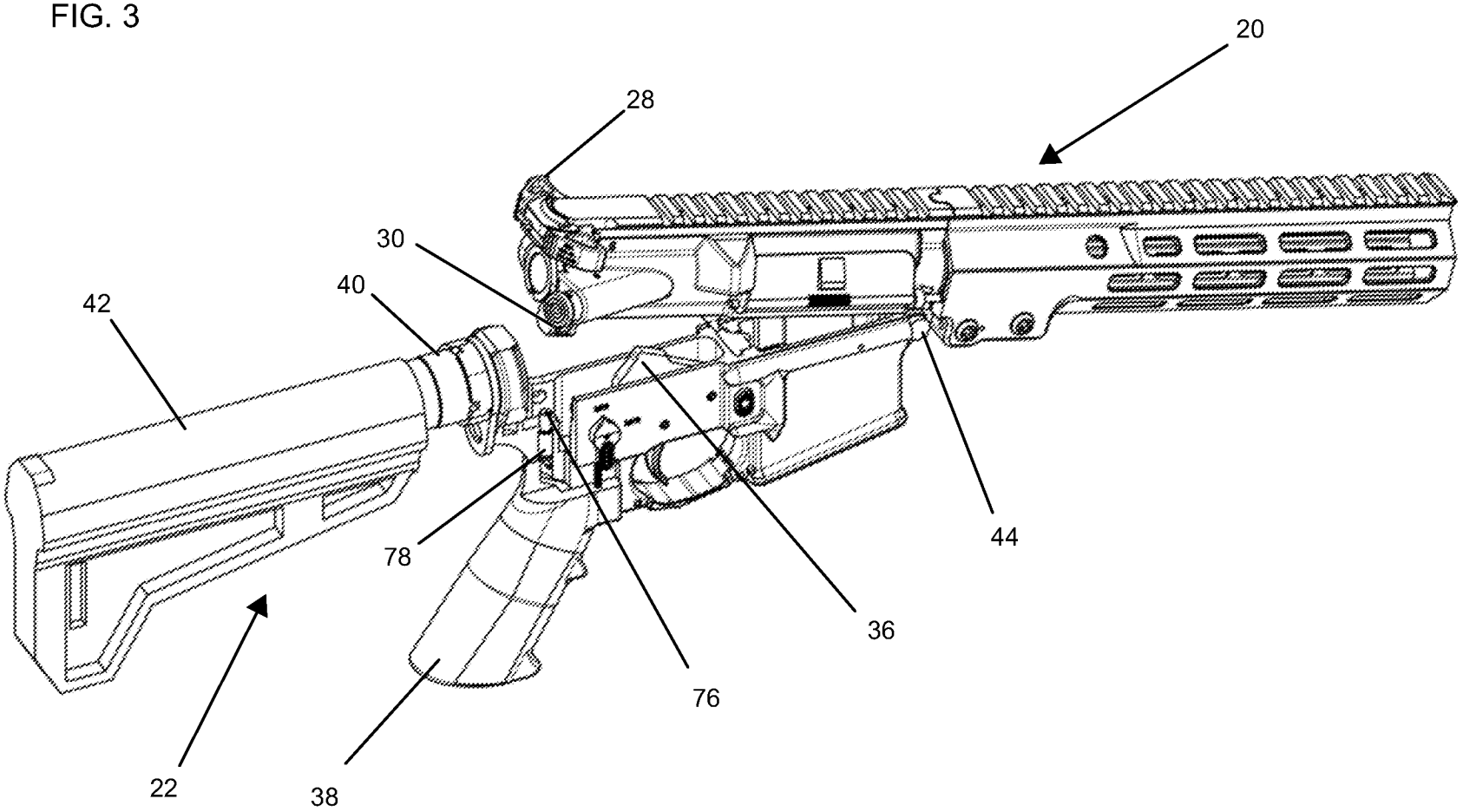
FIG. 3 illustrates a top-rear perspective view of the upper and lower receiver groups shown in FIGS. 1 and 2, depicting the upper and lower receivers in the partially mated condition, with the portion of the lower receiver cut away to reveal the anti-rattle biasing device.
Figure 5:
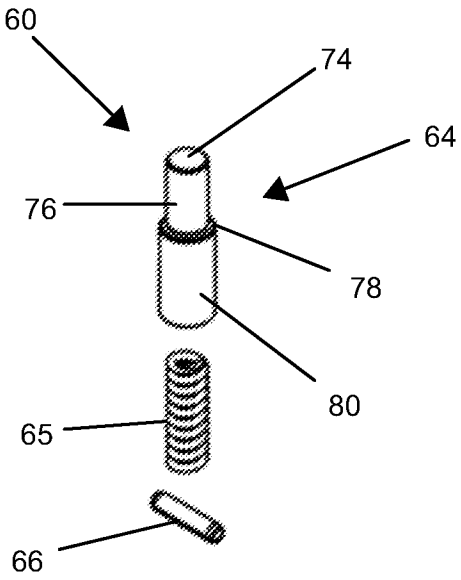
FIG. 5 illustrates an exploded perspective view of the anti-rattle biasing device shown in FIGS. 2-4.

The upper receiver 26 is mated to the lower receiver 34 by positioning the flange on the forward end of the upper receiver 26 between the flanges 48 of the lower receiver 34 while the upper receiver 26 is tilted downward as shown in FIGS. 2 and 3; and aligning the through holes 46 in the flanges 48 with the through hole in the flange on forward end of the upper receiver 26. The pivot pin 44 is inserted through the aligned through holes to couple the forward ends of the upper and lower receivers 26, 34.

Figure 8:
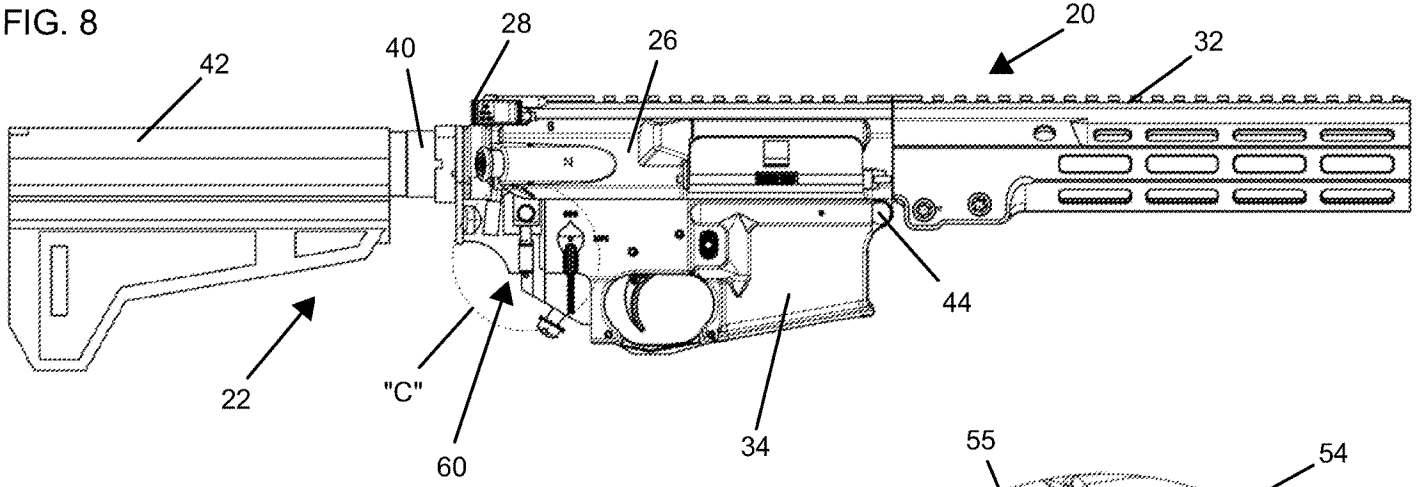
FIG. 8 illustrates a side view of the upper and lower receiver groups shown in FIGS. 1-4, 6, and 7, depicting the upper and lower receivers in the fully mated condition, with the portion of the lower receiver cut away to reveal the anti-rattle biasing device.
Figure 9:
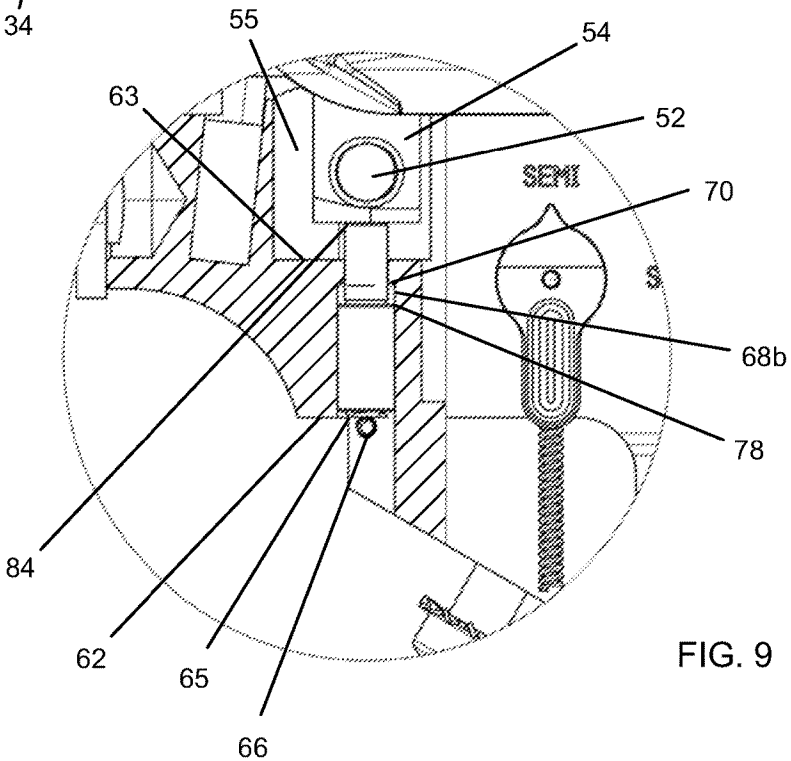
FIG. 9 illustrates a magnified view of the area designated "C" in FIG. 7, depicting the plunger of the anti-rattle biasing device in a lower position.

The upper receiver 26 then is rotated about the pivot pin 44 to a substantially level orientation as shown in FIGS. 1 and 9, to align the through hole 52 in the takedown lug 54 with the through holes 50 in the lower receiver 34; and the takedown pin 47 is inserted through the aligned through hole 52 and through holes 50, to couple the rearward ends of upper and lower receivers 26, 34. As can be seen in FIG. 8, the takedown lug 54 is positioned within a cavity 55 formed in the lower receiver 34 once the upper and lower receivers 26, 34 have been mated.

The lower receiver group 22 includes an anti-rattle biasing device 60. The biasing device 60 is mounted on the lower receiver 34, and is configured to exert an upward force on the upper receiver 26. The upward force inhibits rattling and other low-displacement, back and forth movement of the upper receiver 26 in relation to the lower receiver 34. Such movement otherwise can result from the manufacturing clearances that normally exist between the adjacent surfaces of the upper receiver 26, lower receiver 34, pivot pin 44, and takedown pin 47, and from normal wear of these components.

The biasing device 60 is positioned within a bore 61 formed in the lower receiver 34. As can be seen for example in FIG. 4, the bore 61 extends between a lower surface 62 of the lower receiver 34; and a bottom surface or floor 63 of the cavity 55. The bore 61 is aligned with the takedown lug 54 when the upper receiver 26 is mated with the lower receiver 34, as can be seen in FIG. 9.

Referring to FIGS. 4, 5, 7, 9, and 11, the biasing device 60 comprises a plunger 64; a spring 65, and a retaining pin 66. The spring 65 is positioned within the plunger 64. The plunger 64 has an open end and a closed end, with the open end facing downward from the perspective of FIG. 11. The retaining pin 66 is positioned below the plunger 64 and the spring 65, and prevents the plunger 64 and the spring 65 from backing out of the bore 61 in the downward direction.

Figure 4:
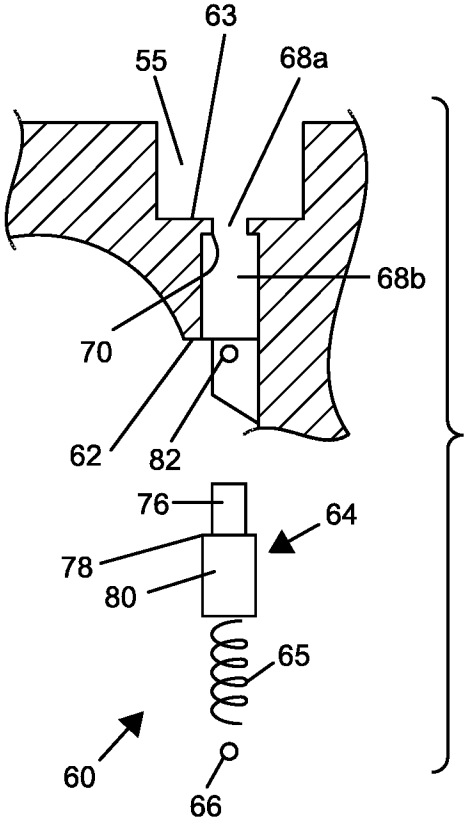
FIG. 4 illustrates a magnified view of the area designated "A" in FIG. 2, showing the anti-rattle biasing device in an exploded condition below the lower receiver.
Figure 6:
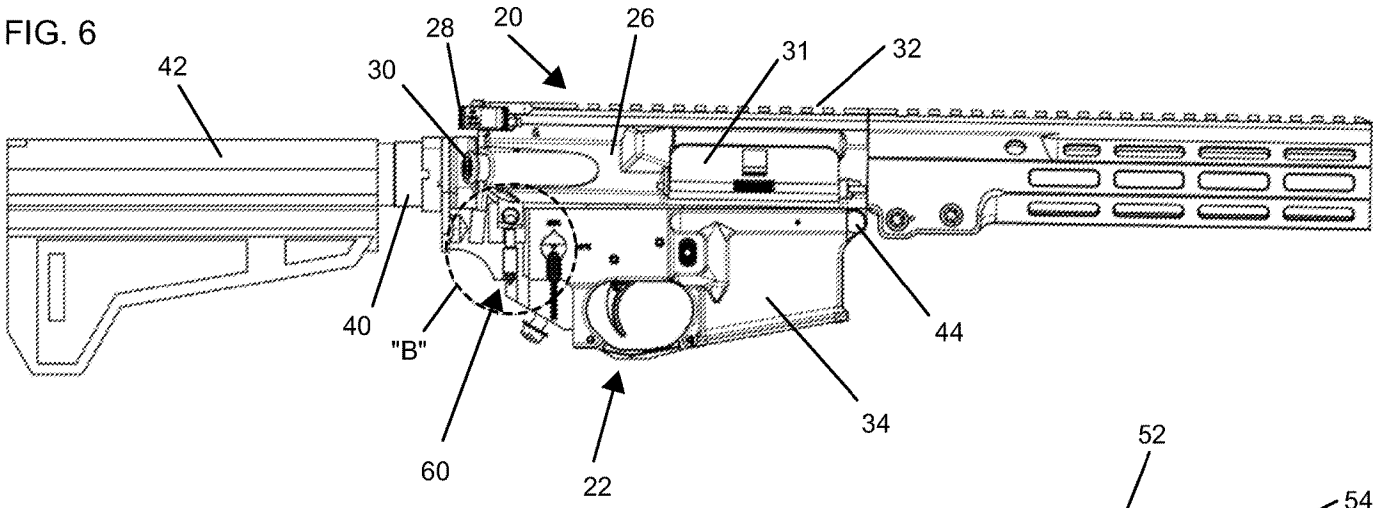
FIG. 6 illustrates a side view of the upper and lower receiver groups shown in FIGS. 1-4, depicting the upper and lower receivers approaching the fully mated condition, with the portion of the lower receiver cut away to reveal the anti-rattle biasing device.

The bore 61 has a first or upper portion 68*a*, and a second or lower portion 68*b*, as can be seen in FIG. 4. The upper and lower portions 68*a*, 68*b* are cylindrical. The outer diameter of the upper portion 68*a* is less than that of the lower portion 68*b*. As a result of the reduction in diameter between the upper and lower portions 68*a*, 68*b*, the lower receiver 34 defines a lip 70 located along the interface between the lower and upper portion 68*b*, 68*a*. The lip 70 faces downward, toward the lower portion 68*b*, as shown in FIG. 4.

The plunger 64 is formed from a relatively strong and durable material such as stainless steel; the plunger 64 can be formed from other materials in the alternative. The plunger 64 has a substantially planar upper surface 74; and a first or upper sidewall 76 that adjoins the upper surface 74. The plunger 72 also includes a lip 78, and a second or lower sidewall 80. The lip 78 adjoins, and connects the upper sidewall 76 and the lower sidewall 80.

The outer diameter of the upper sidewall 76 is selected so that the upper sidewall 76 fits within the upper portion 68*a* of the bore 61 with minimal clearance. The outer diameter of the lower sidewall 80 is selected so that the lower sidewall 80 fits within the lower portion 68*b* of the bore 61 with minimal clearance as can be seen, for example, in FIG. 7.

Figure 11:
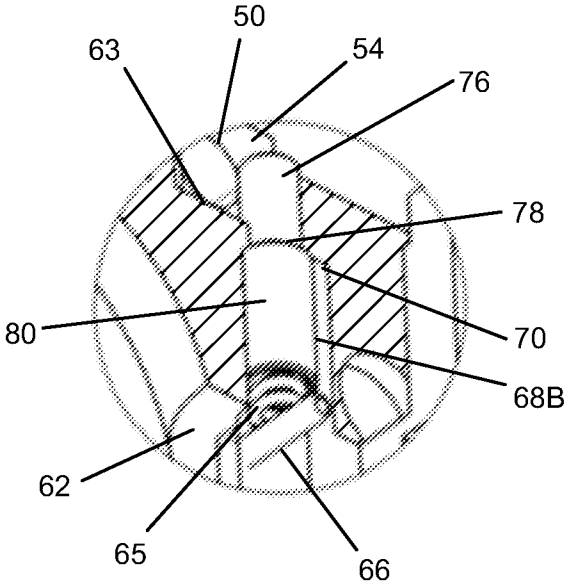
FIG. 11 illustrates a magnified view of the area designated "C" in FIG. 10, depicting the plunger of the anti-rattle biasing device in the upper position.
Figure 10:
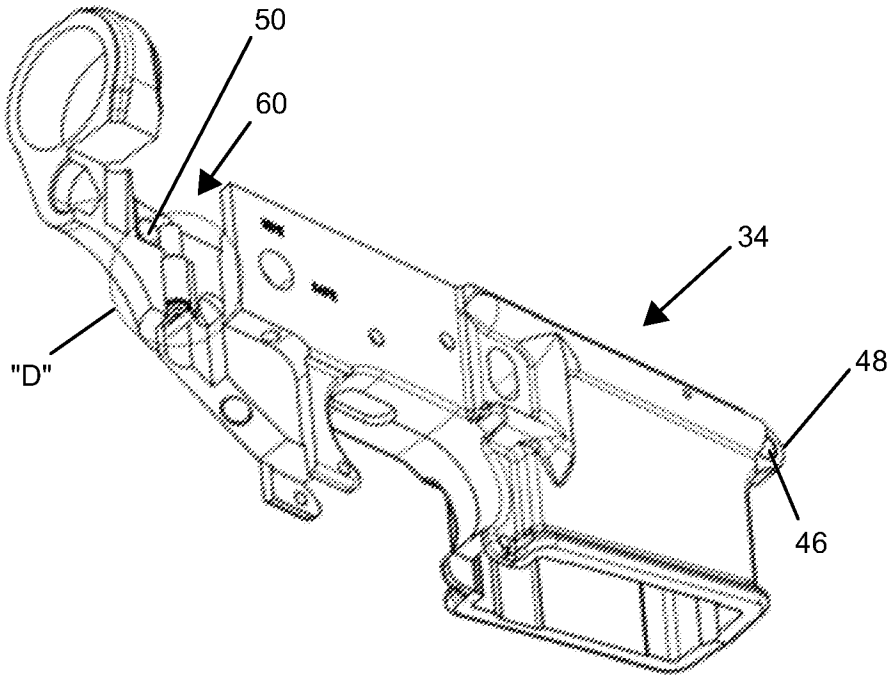
FIG. 10 illustrates a bottom perspective view of the lower receiver shown in FIGS. 1-4 and 6-9, with the portion of the lower receiver cut away to reveal the anti-rattle biasing device.

The plunger 64 is inserted into the bore 61 from the bottom of the bore 61, from the perspective of FIG. 11. The lip 70 on the lower receiver 34 acts as a stop on the upward movement of the plunger 64. In particular, interference between the lip 78 of the plunger 64 and the lip 70 limits the upward movement of the plunger 64 to an upper position depicted, for example, in FIGS. 7 and 11.

The length, or vertical dimension of the upper portion of the upper sidewall 76 is selected so that a portion of the upper sidewall 76 protrudes from the upper end of the bore 61 and extends into the cavity 55 when the plunger 64 is in its upper position. In some embodiments, the upper sidewall 76 can extend into the cavity 55 by about ⅛ inch to about ½ inch, such as about ¼ inch, when the plunger 64 is in its upper position, i.e., the upper surface 74 of the plunger 64 can be located about ⅛ inch to about ½ inch, such as about ¼ inch, above the floor 63 of the cavity 55 when the plunger 64 is in its upper position. The extent to which the plunger 64 extends into the cavity 55 is application-dependent, and can vary with factors such as the desired amount of force the biasing device 60 is to exert on the upper receiver 26, the dimensions of the upper and lower receivers 26, 34, the spring constant of the spring 65, the manufacturing tolerances of the upper and lower receivers 26, 34, the pivot pin 44, and the takedown lug 54, and the like. The upper sidewall 76 can extend into the cavity 55 by more, or less than about 1/32 inch in alternative embodiments.

The upper sidewall 76 can have an outer diameter of about 5/32 inch to about 7/32 inch; and a height, or vertical dimension, of about 5/16 inch to about ⅜ inch. The lower sidewall 80 can have an outer diameter of about 7/32 inch to about 9/32 inch; and a height, or vertical dimension, of about 7/16 inch to about ½ inch. These dimensions are presented for illustrative purposes only; the upper and lower sidewalls 76, 80 can have other dimensions in alternative embodiments.

The spring 65 is a helical coil spring. The spring 65 is a linear spring, i.e., the relationship between the displacement of the spring 65 and the force exerted by the spring 65 is linear. The spring 65 can be a non-linear spring in alternative embodiments. The spring 65 can have a spring constant of about 150 pounds per inch to about 250 pounds per inch, such as about 175 pounds per inch to about 225 pounds per inch. The optimum spring constant for the spring 65 is application-dependent, and can vary with factors such as the desired amount of force the biasing device 60 is to exert on the upper receiver 26, the overall length of the spring 65, the deflection of the spring 65 when the upper and lower receivers 26, 34 are mated, and the like. The spring 65 can have a spring constant greater, or less than the above range in alternative embodiments.

The spring 65 has an outer diameter about equal to an inner diameter of the upper sidewall 76 of the plunger 64, so that the spring 65 can fit within the upper sidewall 76 with minimal clearance. The spring 65 has an overall length, in its uncompressed state, that is greater than the height, or vertical dimension, the plunger 64, so that the plunger 64 can move downward in the bore 61 before bottoming out on the retaining pin 66. The overall uncompressed length of the spring 65 can be about ½ inch to about ⅝ inch. The optimum length of the spring 65 is application-dependent, and can vary with factors such as the desired amount of force the biasing device 60 is to exert on the upper receiver 26, the spring constant of the spring 65; the overall height of the plunger 64, the deflection of the spring 65 when the upper and lower receivers 26, 34 are mated, and the like. The spring 65 can have a length greater, or less than the above range in alternative embodiments.

As noted above, the retaining pin 66 is positioned below the plunger 64 and the spring 65, and prevents the plunger 64 and the spring 65 from backing out of the bore 61 in the downward direction. The retaining pin 66 extends across the lower portion 68*b* of the bore 61. The ends of the retaining pin 66 are disposed in through holes 82 formed in opposite sides of the lower receiver 34. One of the through holes 82 is visible in FIG. 4. The retaining pin 66 can be retained in the through holes 82 by a press fit or other suitable means.

Figure 7:
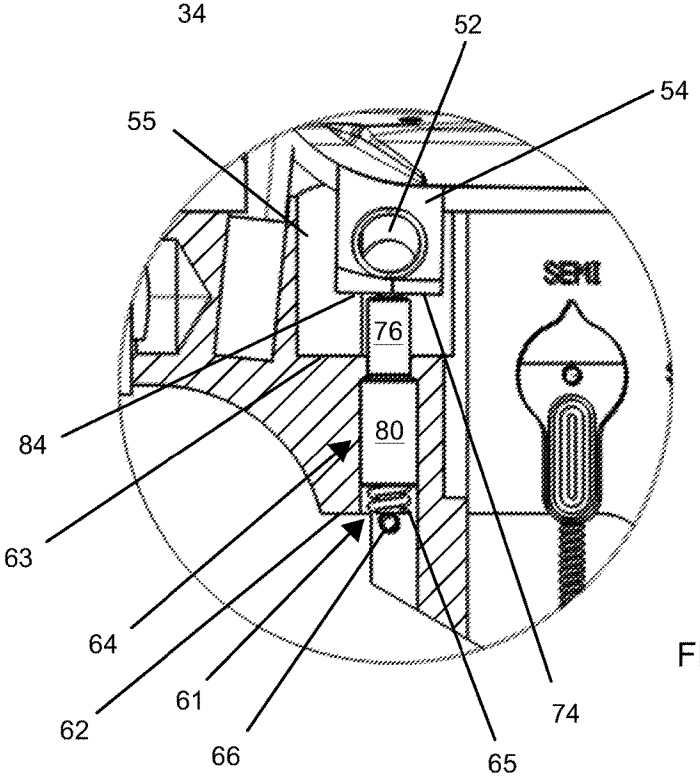
FIG. 7 illustrates a magnified view of the area designated "B" in FIG. 6, depicting a plunger of the anti-rattle biasing device in an upper position.

The biasing device 60 can be installed on the lower receiver 34 by, for example, inverting the lower receiver 34 so that the lower, or wider end of the bore 61 faces upward. The plunger 64 then can be inserted into the bore 61 so that the upper sidewall 76 becomes disposed in the upper portion 68*a* of the bore 61 and protrudes partially into the cavity 55 of the lower receiver 34 as discussed above; and the lower sidewall 80 becomes disposed in the lower portion 68*b* of the bore 61. As can be seen in FIGS. 7 and 11, interference between the lip 78 of the plunger 64 and the lip 70 on the lower receiver 34 limits the movement of the plunger 64 toward the upper, or narrower end of the bore 61, so that the plunger 64 assumes its upper position within the bore 61.

The spring 65 can be dropped into the inverted plunger 64, so that an end of the spring 65 rests against the closed, i.e., upper, end of the plunger 64. If necessary, the spring 65 can be compressed slightly using suitable tooling, so that the spring 65 clears the through holes 82. The retaining pin 66 then can be inserted into the through holes 82, to secure the spring 65 and the plunger 64 in the bore 61, thereby completing installation of the biasing device 60.

Once the biasing device 60 has been installed in the lower receiver 34, the upper receiver 26 can be mated with the lower receiver 34 in the above-described manner. As noted above, the bore 61 aligns with the takedown lug 54 when the upper and lower receivers 26, 34 are mated; and the uppermost portion of the plunger 64 protrudes from the bore 61 and into the cavity 55 when the upper and lower receivers 26, 34 are in a less than fully mated state. Consequently, a lower surface 84 of the takedown lug 54 contacts the upper surface 74 of the plunger 64 as the upper receiver 26 is rotated about the pivot pin 44 during the final stage of its mating process with the lower receiver 34, as depicted in FIG. 7.

Once the lower surface 84 of the takedown lug 54 contacts the upper surface 74 of the plunger 64, continued rotation of the upper receiver 26 causes the takedown lug 54 to exert a downward force on the plunger 64, and to move the plunger 64 downward, from the perspective of FIG. 9. Because the spring 65 is restrained on its bottom end by the retaining pin 66, the downward movement of the plunger 64 causes the spring 65 to compress as shown in FIG. 9.

The through hole 52 in the takedown lug 54 aligns with the through holes 50 in the lower receiver 34 when the upper receiver 26 has been rotated to its fully mated position. The takedown pin 47 is inserted into the aligned through holes 50, 52 to secure the forward ends of the upper and lower receiver 26, 34.

At this point, the spring 65 has reached its maximum compression. The compressed spring 65 exerts an upward reactive force on the upper receiver 26 via the upper surface 74 of the plunger 64 and the contacting lower surface 84 of the takedown lug 54. In addition, the spring 65 exerts a downward reactive force on the lower receiver 34 via the retaining pin 66. These counteracting forces urge the surfaces of the upper and lower receivers 26, 34 adjacent the pivot pin 44 and the takedown pin 47 firmly into contact with the respective pivot pin 44 and takedown pin 47. This contact in turn inhibits small relative movement between the upper and lower receivers that otherwise could result in rattling.

This biasing device 60 generates the above-noted biasing force automatically, upon the mating of the upper and lower receivers 26, 34. Thus, once the biasing device 60 has been installed, the anti-rattle bias is achieved with no action required on the part of the user other than mating the upper and lower receivers 26, 34 in the normal manner. Also, there is no need to reinstall the biasing device 60 when the upper and lower receivers 26, 34 are de-mated and then re-mated. And the biasing device 60 does not require any trimming or adjustment, since the spring 65 can exert a sufficient biasing force over the ranges of clearances normally expected between the upper and lower receivers 26, 34 and the pivot and takedown pins 44, 47.

A set screw can be used in lieu of the retaining pin 66 in alternative embodiments, to retain the spring 65 and the plunger 64 in the bore 61. The set screw can be retained in the bore 61 by threads formed around the lower periphery of the bore 61. In other alternative embodiments, the bore 61 can have a closed bottom, i.e., the bore 61 can stop short of the lower surface 62 of the lower receiver 34; and the spring 65 and plunger 64 can rest on the structure that defines the bottom of the bore 61. In such embodiments, the plunger 64 and the bore 61 are formed without the respective lip 78 and lip 70, so that the plunger 64 can be inserted into the bore 61 from a position above the bore 61. In other alternative embodiments, a spring plunger can be used in lieu of the spring 65, the plunger 64, and the retaining pin 66. In such embodiments, the bore 61 can have a constant diameter, and can have threads formed around the periphery thereof to engage the threaded body of the spring plunger. In other alternative embodiments, the biasing device 60, and variants thereof, can be installed on the upper receiver 26.

We claim:

1. A lower receiver group for a firearm, the lower receiver group comprising:

a lower receiver configured to mate with an upper receiver of the firearm; and a biasing device positioned at least partly within a bore formed in the lower receiver, the biasing device comprising:

a spring configured to compress when the upper receiver is mated with lower receiver, and to exert opposing forces on the upper receiver and the lower receiver in response to the compression of the spring; and a plunger comprising a first portion having a first diameter, a second portion having a second diameter greater than the first diameter, and a plunger lip that connects the first and second portions; wherein the spring is positioned at least partly within the plunger and urges the plunger in a first direction;

wherein the bore comprises a first portion configured to receive the first portion of the plunger and having a diameter approximately equal to the diameter of the first portion of the plunger; and a second portion configured to receive the second portion of the plunger and having a diameter approximately equal to the diameter of the second portion of the plunger; and wherein the lower receiver comprises a lower receiver lip facing the second portion of the bore and configured to contact the plunger lip to limit movement of the plunger and the spring in the first direction.

2. The lower receiver group of claim 1, wherein the biasing device further comprises a retaining pin configured to retain the plunger and the spring in the bore.

3. The lower receiver group of claim 1, wherein each of the first and second portions of the plunger is substantially cylindrical.

4. The lower receiver group of claim 1, wherein the biasing device further comprises a retaining pin configured to limit movement of the plunger and the spring in a second direction opposite the first direction.

5. The lower receiver group of claim 1, wherein:

the lower receiver defines a cavity configured to receive a takedown lug on the upper receiver when the upper and lower receivers are mated;

the spring is configured to extend into the cavity when the upper and lower receivers are not mated; and the spring is further configured to be compressed by the takedown lug when the upper and lower receivers are mated.

6. The lower receiver group of claim 5, wherein:

the plunger is configured so that the takedown lug contacts the plunger when the upper and lower receivers are mated.

7. The lower receiver group of claim 6, wherein the bore extends between the cavity and a lower surface of the lower receiver.

8. The lower receiver group of claim 1, wherein:

the lower receiver is configured to be coupled to the upper receiver by a first and a second pin;

the opposing forces on the upper receiver and the lower receiver urge the first pin into contact with structure of the upper receiver and the lower receiver adjacent the first pin; and the opposing forces on the upper receiver and the lower receiver urge the second pin into contact with structure of the upper receiver and the lower receiver adjacent the second pin.

9. A firearm comprising the lower receiver group of claim 1.

10. A firearm, comprising:

an upper receiver group comprising an upper receiver; and a lower receiver group comprising:

a lower receiver configured to mate with the upper receiver; and a biasing device positioned at least partly within a bore formed in the lower receiver, the biasing device comprising: a spring configured to compress when the upper receiver is mated with lower receiver, and to exert opposing forces on the upper receiver and the lower receiver in response to the compression of the spring; and a plunger comprising a first portion having a first diameter, a second portion having a second diameter greater than the first diameter, and a plunger lip that connects the first and second portions; wherein the spring is positioned at least partly within the plunger and urges the plunger in a first direction;

wherein the bore comprises a first portion configured to receive the first portion of the plunger and having a diameter approximately equal to the diameter of the first portion of the plunger; and a second portion configured to receive the second portion of the plunger and having a diameter approximately equal to the diameter of the second portion of the plunger; and wherein the lower receiver comprises a lower receiver lip facing the second portion of the bore and configured to contact the plunger lip to limit movement of the plunger and the spring in the first direction.

11. The firearm of claim 10, wherein:

each of the first and second portions of the plunger is substantially cylindrical portions;

the bore comprises a first portion configured to receive the first portion of the plunger and having a diameter approximately equal to the diameter of the first portion of the plunger; and a second portion configured to receive the second portion of the plunger and having a diameter approximately equal to the diameter of the second portion of the plunger; and the lower receiver comprises a lip facing the second portion of the bore and configured to contact the lip of the plunger to limit movement of the plunger and the spring in a first direction.

12. The firearm of claim 11, wherein the biasing device further comprises a retaining pin configured to limit movement of the plunger and the spring in a second direction opposite the first direction.

13. The firearm of claim 10, wherein:

the upper receiver comprises a takedown lug;

the lower receiver defines a cavity configured to receive the takedown lug when the upper and lower receivers are mated;

the spring is configured to extend into the cavity when the upper and lower receivers are not mated; and the spring is further configured to be compressed by the takedown lug when the upper and lower receivers are mated.

14. The firearm of claim 13, wherein:

the plunger is configured so that the takedown lug contacts the plunger when the upper and lower receivers are mated.

15. The firearm of claim 13, wherein: the bore extends between the cavity and a lower surface of the lower receiver.

16. The firearm of claim 13, further comprising:

a pivot pin configured to couple a forward end of the upper receiver to a forward end of the lower receiver; and a takedown pin configured to couple the takedown lug to the lower receiver, wherein the opposing forces on the upper receiver and the lower receiver urge the pivot pin into contact with structure of the upper receiver and the lower receiver adjacent the pivot pin; and the opposing forces on the upper receiver and the lower receiver urge the takedown pin into contact with the takedown lug and structure of the receiver adjacent the takedown pin.

* * * * *